US006910763B2

(12) United States Patent
Hou et al.

(10) Patent No.: US 6,910,763 B2
(45) Date of Patent: Jun. 28, 2005

(54) INK STORAGE UNIT

(75) Inventors: I-Chung Hou, Hsinchu (TW); Cheng-Wei Hsu, Tai-Nan (TW)

(73) Assignee: International United Technology Co., Ltd., Hsin-Chu (TW)

( * ) Notice: Subject to any disclaimer, the term of this patent is extended or adjusted under 35 U.S.C. 154(b) by 0 days.

(21) Appl. No.: 10/707,141

(22) Filed: Nov. 24, 2003

(65) Prior Publication Data

US 2004/0104983 A1 Jun. 3, 2004

Related U.S. Application Data

(62) Division of application No. 10/064,611, filed on Jul. 31, 2002, now Pat. No. 6,817,706.

(30) Foreign Application Priority Data

May 31, 2002 (TW) ..... 91208003 U

(51) Int. Cl.[7] ..... B41J 2/175
(52) U.S. Cl. ..... 347/86
(58) Field of Search ..... 347/86, 87, 85

(56) References Cited

U.S. PATENT DOCUMENTS 6,224,200 B1 * 5/2001 Higuma et al. ..... 347/86
2003/0020790 A1 * 1/2003 Kotaki et al. ..... 347/86
2003/0052951 A1 * 3/2003 Ujita et al. ..... 347/86
2003/0146960 A1 * 8/2003 Chiu et al. ..... 347/87

* cited by examiner

*Primary Examiner*—K. Feggins
(74) *Attorney, Agent, or Firm*—Jianq Chyun IP Office

(57) ABSTRACT

An ink storage unit comprises an ink tank that defines an inner confinement space in which is placed an ink storage body to store and retain ink. The ink tank includes an air inlet through which air passage in the ink tank is enabled, and an ink outlet through which ink output is achieved. An outer surface of the ink storage body includes a plurality of notches distributed along an interface between the ink storage body and the ink tank, thereby forming a plurality of gaps that locally separate the outer surface of the ink storage body from the sidewall of the ink tank. Alternatively, the ink storage body is comprised of a first ink storage portion that is separated from a second ink storage portion via a spacing member. Ink flowing and leakage through the air inlet is thereby prevented.

18 Claims, 3 Drawing Sheets

INK STORAGE UNIT

CROSS REFERENCE TO RELATED APPLICATIONS

This application is a divisional of a prior application Ser. No. 10/064,611, filed Jul. 31, 2002, now U.S. Pat. No. 6,817,706 which claims the priority benefit of Taiwan application serial no. 91208003, filed on May 31, 2002.

BACKGROUND OF INVENTION

1. Field of the Invention

The invention relates generally to an ink storage unit and, more particularly, to an ink storage unit that can prevent reverse ink flowing causing ink leakage.

2. Description of the Related Art

Due to its advanced development, inkjet printing technology is broadly implemented in many types of printing apparatuses such as printers or facsimile machines. Inkjet printing technology principally consists of an inkjet print head that produces a high pressure to eject ink droplets out of the print head on the printed document, thereby forming an ink point thereon. By an adequate disposition of the numerous ink points on the printed documents, characters or graphics hence are formed. To continuously supply the inkjet print head with ink, an ink storage unit is traditionally used to store ink.

To prevent ink leakage out of the ink storage unit, a method of the prior art uses a pressure regulator that is disposed within an ink tank of the ink storage unit. The pressure regulator adequately regulates a pressure differential between the interior and the exterior of the ink tank by creating a negative pressure that keeps the ink from leaking out. Another method known in the prior art is to arrange an ink storage body made of porous material such as sponge or fabric within the ink tank. Via capillary action of the porous ink storage body, the ink can be stored and retained within the ink tank.

FIG. 1 is a sectional view that schematically illustrates the construction of an ink storage unit known in the prior art. As illustrated, a traditional ink storage unit 100 principally comprises an ink tank 110 that defines a confinement space 112 in which an ink storage body 120 is placed. The ink storage body 120 is made of a porous material such as sponge that enables to store and retain ink within the ink tank 110 by capillary action. The ink tank 110 further includes an ink outlet 114 at a lower side to output ink to an ink-ejecting member 300. An upper side of the ink tank 110 is further provided with an air inlet 116 through which air is enabled to penetrate the confinement space 112 of the ink tank 110. While the ink is outputted through the ink outlet 114, the external air simultaneously penetrates into the ink tank 110 through the air inlet 116 so as to achieve an adequate pressure balance of the confinement space 112 with respect to the external pressure. Ink output through the ink outlet 114 can be thereby sustained to supply the ink-ejecting member 300.

The introduction of ink within the ink tank 110 is usually achieved via ink injection by means of a syringe inserted through the air inlet 116 to the lower half of the ink storage body 120. However, ink stored in the ink storage body 120 may flow along the interface 130 between the outer surface of the ink storage body 120 and the inner sidewall of the ink tank and leak out through the air inlet 116. Therefore, the prior art further disposes a notch 121 on the outer surface of the ink storage body 120 facing the air inlet 116. The outer surface of the ink storage body 120 at that location is thereby separated a higher distance from the air inlet 116. Ink flowing through the interface 130 thus cannot contact with the air inlet 116 at the location of the notch 121 and, consequently, ink leakage is prevented.

However, the above disposition becomes deficient when the ink storage unit 100 is subject to significant external shaking, and ink leakage through the air inlet 116 hence still occurs.

SUMMARY OF INVENTION

An aspect of the invention is therefore to provide an ink storage unit that can effectively prevent ink leakage through the air inlet.

To accomplish the above and other objectives, an ink storage unit of the invention comprises an ink tank that defines an inner confinement space in which is placed an ink storage body to store and retain ink. The ink tank respectively includes an air inlet through which air passage into the ink tank is enabled, and an ink outlet through which ink output is achieved. The ink storage body is comprised of a first end portion approximately close to the air inlet and a second end portion approximately close to the ink outlet and relatively farther from the air inlet. An outer surface of the ink storage body includes a plurality of notches distributed along an interface between the ink storage body and the ink tank, thereby forming a plurality of gaps that locally separate the outer surface of the ink storage body from the sidewall of the ink tank to cut off ink flowing there along.

In accordance with the above objectives of the invention, the ink storage body is alternatively comprised of a first ink storage portion separated from a second ink storage portion via a spacing member. The first ink storage portion is placed approximately close to the air inlet and the second ink storage portion is placed approximately close to the ink outlet and relatively farther from the air inlet. The spacing member creates a spacing gap between the first and second ink storage portions so that reverse ink flowing causing ink leakage through the air inlet is prevented.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 1:
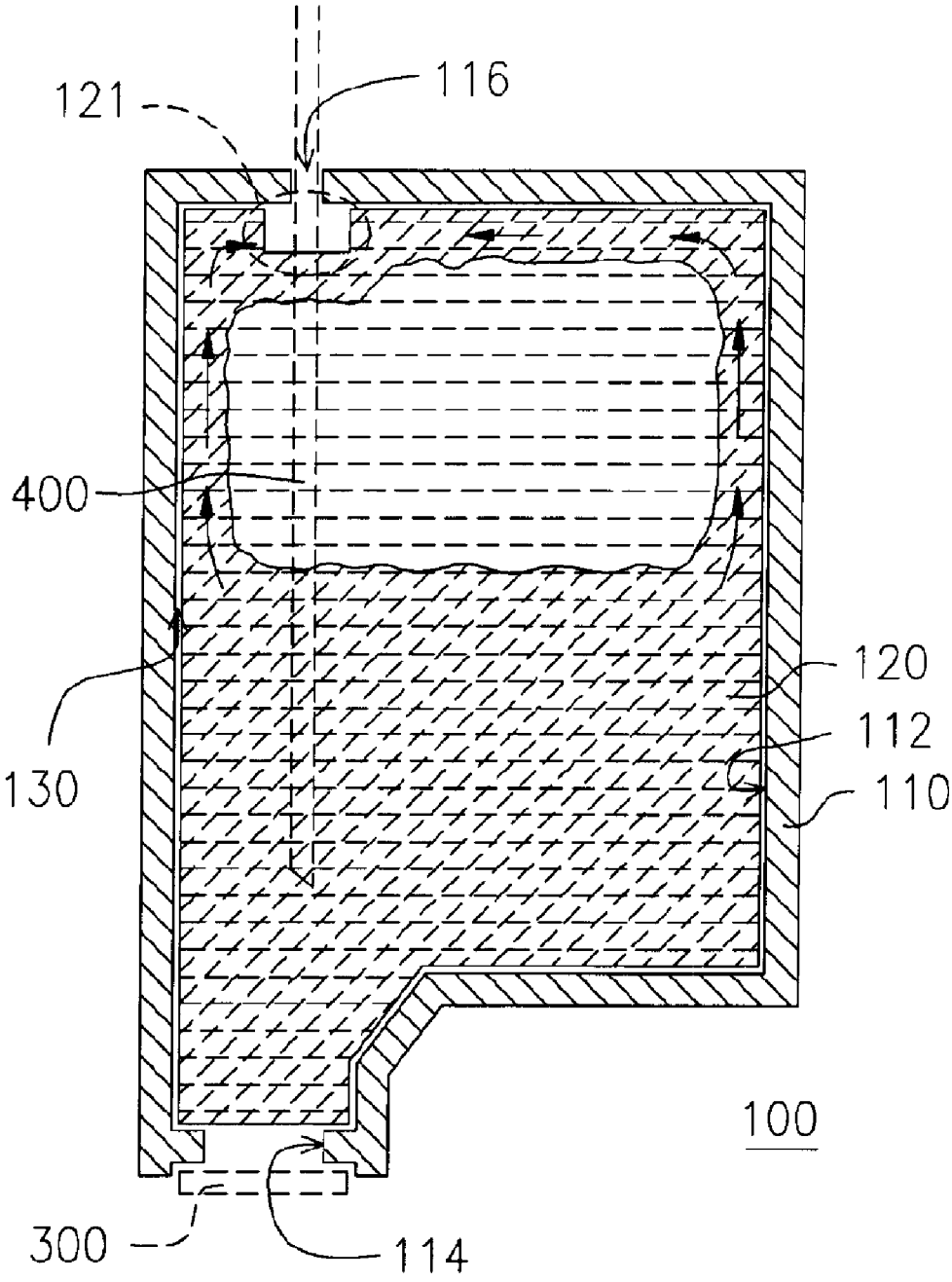
FIG. 1 (PRIOR ART)
FIG. 1 is a sectional view illustrating a traditional ink storage unit of the prior art.

The following detailed description of the embodiments and examples of the present invention with reference to the accompanying drawings is only illustrative and not limiting. Wherever possible in the following description and accompanying drawings, like reference numerals and symbols will refer to like elements and parts unless otherwise described.

Figure 2:
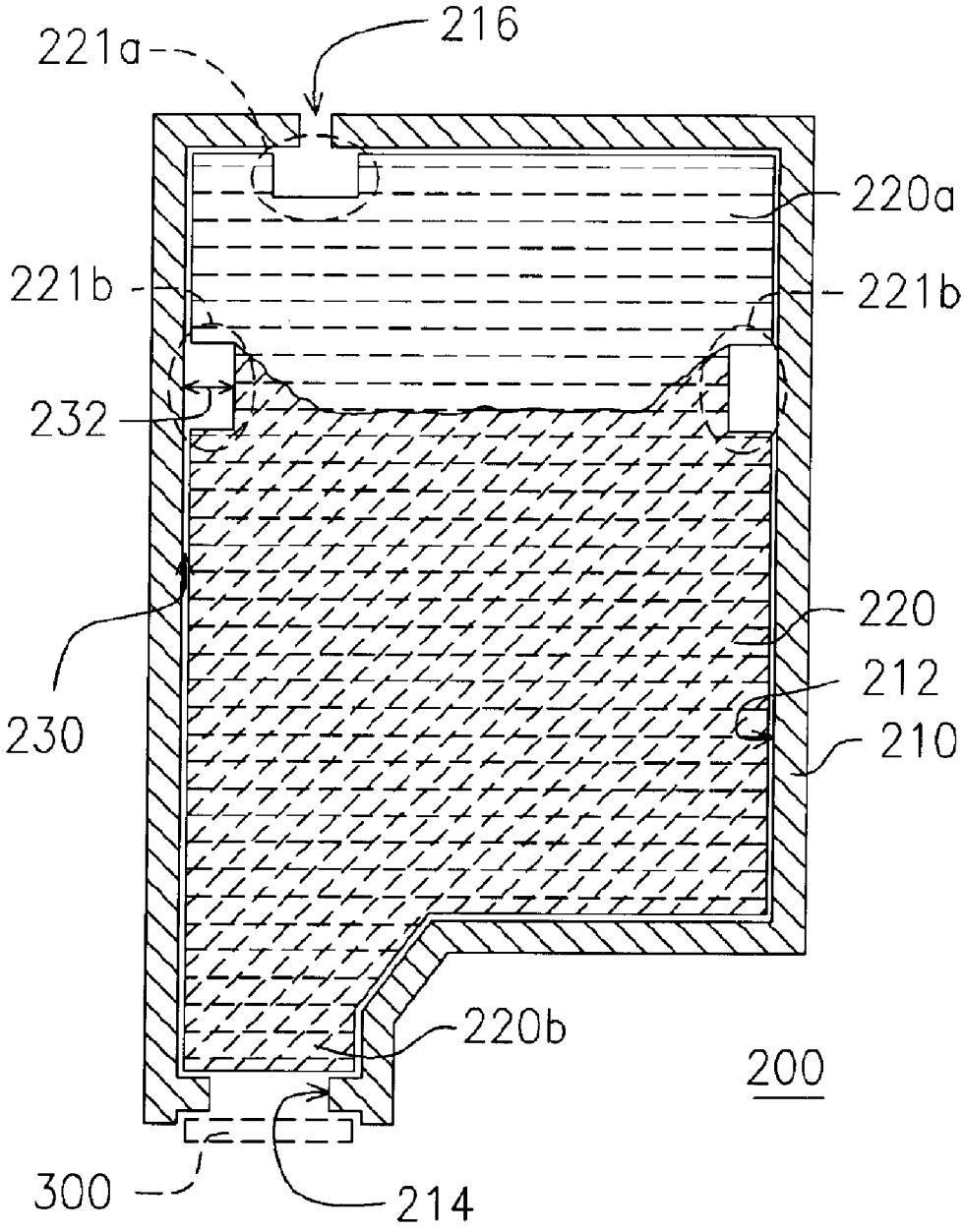
FIG. 2 is a sectional view illustrating an ink storage unit according to an embodiment of the invention.

Referring to FIG. 2, a sectional view schematically illustrates the construction of an ink storage unit according to an embodiment of the invention. As illustrated, an ink storage unit 200 of the invention principally comprises an ink tank 210 that defines an inner confinement space 212 in which is disposed an ink storage body 220. The ink storage body 220 is preferably made of a porous material such as sponge or fabric. The inner pores of the ink storage body 220 are used to absorb and retain ink by capillary action. A lower side of the ink tank 210 is provided with an ink outlet 214 through which the ink is conducted out of the confinement space to an ink-ejecting member 300. An upper side of the ink storage unit 200 is further provided with an air inlet 216 through which an external air is enabled to enter within the confinement space 212. Hence, when a portion of ink is outputted through the ink outlet 214, external air gas simultaneously enters the confinement space 212 to achieve an adequate pressure balance with the exterior environment. The ink output through the ink outlet 214 to the ink-ejecting member 300 can be thereby sustained.

To prevent ink leakage through the air inlet 216, usually caused by an ink flow along an interface 230 between the ink storage body 220 and an inner sidewall of the ink tank 210, a plurality of notches 221*b* are formed on the ink storage body 220. More particularly, the notches 221*b* are distributed along the outer surface of the ink storage body 220 at first and second end portions 220*a*, 220*b* thereof. The first end portion 220*a* designates a portion of the ink storage body 220 that is approximately close to the air inlet 216, and the second end portion 220*b* designates a portion of the ink storage body 220 that is approximately close to the ink outlet 214 and relatively farther from the air inlet 216. The disposition of notches 221*b* hence creates a distribution of gaps 232 that cut off the continuity of the interface 230 to the air inlet 216. Via adequate geometry, curvature and depth of the gaps 232, the ink flowing path along the interface 230 is lengthened meanwhile the progression of ink flow is hampered. Reverse ink flow causing leakage through the air inlet 216 is thereby substantially reduced. An adequate geometry of the gaps 232 may be, for example, a circular recess that runs around the outer surface of the ink storage body 220 from the first portion 220*a* to the second end portion 220*b*.

Figure 3:
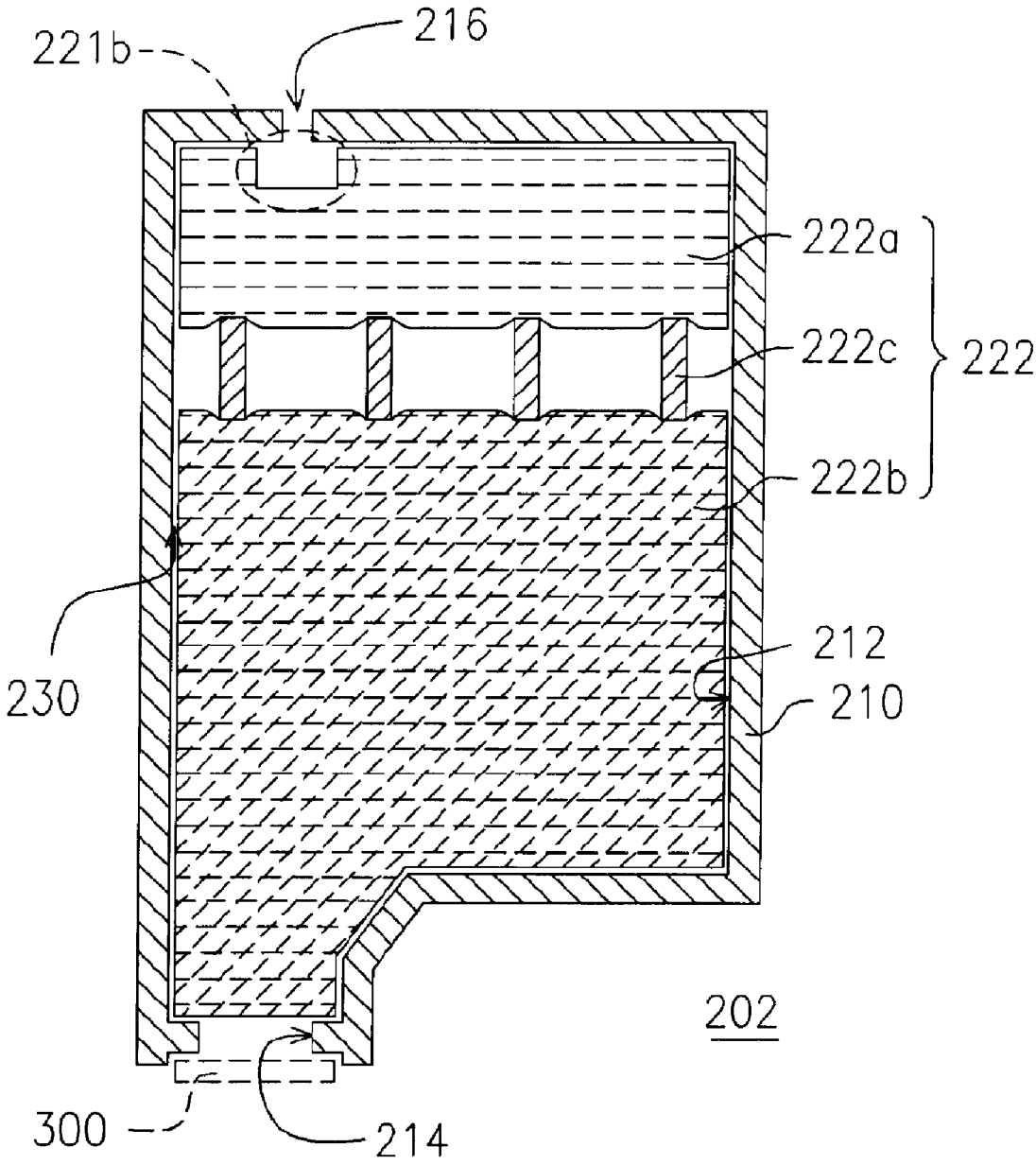
FIG. 3 is a sectional view illustrating an ink storage unit according to another embodiment of the invention.

Referring to FIG. 3, a sectional view schematically illustrates the construction of an ink storage unit according to another embodiment of the invention. In this embodiment, an ink storage unit 202 similarly includes an ink tank 210 that defines an inner confinement space 212. In the confinement space 212 is disposed an ink storage body 222 that is comprised of a first storage portion 222*a*, a second storage portion 222*b*, and a spacing member 222*c*. The first storage portion 222*a* is placed close to the air inlet 216 while the second storage portion 222*b* is placed close to the ink outlet 214 and relatively farther from the air inlet 216. The spacing member 222*c* is arranged between the first storage portion 222*a* and the second storage portion 222*b* so as to separate both portions 222*a*, 222*b* from each other.

As illustrated in FIG. 3, the spacing member 222*c* may be formed from, for example, a plurality of ribs that oppositely abut against the first and second ink storage portions 222*a*, 222*b*, thereby creating a spacing gap there between. As a result, ink initially stored in the second ink storage portion 222*b* is effectively prevented from reversely flowing to the first ink storage portion 222*a* and leaking out through the air inlet 216. It should be noticed that since the first ink storage portion 222*a* is not principally used to store an important amount of ink, materials of smaller pore density (such as smaller-pore-density sponge or fabric), more economical, can be therefore advantageously used to fabricate the first ink storage portion 222*a*.

As shown in FIG. 2 and FIG. 3, a notch 221*a* in FIG. 2 and notch 221*b* in FIG. 3 placed vis-à-vis the air inlet 216 as conventionally achieved may be further associated with the distribution of gaps of the invention to further efficiently prevent ink leakage through the air inlet 216.

As described above, the invention therefore provides an ink storage unit that effectively prevents ink leakage through the air inlet due to ink flowing along the interface between the ink tank and the ink storage body received therein. For this purpose, an embodiment of the invention provides an ink storage body that is comprised of a plurality of notches formed on an outer surface thereof. The disposition of notches hence forms a distribution of gaps along the interface between the ink storage body and the ink tank that lengthens the ink flowing path to the air inlet and further hampers the progression of ink flow. Another embodiment of the invention provides an ink storage body that is comprised of first and second ink storage portions separated from each other via a spacing member placed there between, the first ink storage portion being close to the air inlet while the second ink storage portion being close to the ink outlet. The above spacing member creates a spacing gap between the first ink storage portion and the second ink storage portion that effectively prevents ink leakage to the air inlet.

It should be apparent to those skilled in the art that other structures that are obtained from various modifications and variations of various parts of the above-described embodiments of the invention would be possible without departing from the scope and spirit of the invention as illustrated herein. Therefore, the above description of embodiments and examples only illustrates specific ways of making and performing the invention that, consequently, should cover variations and modifications thereof, provided they fall within the inventive concepts as defined in the following claims.

What is claimed is:

1. An ink storage unit, comprising:

an ink tank, defining an inner confinement space limited by at least an inner sidewall, and further provided with an air inlet and an ink outlet, the air inlet enabling an external air to enter the confinement space and the ink outlet enabling an ink to be outputted out of the confinement space; and an ink storage body, received within the confinement space, the ink storage body being comprised of:

a first ink storage portion, placed approximately close to the air inlet;

a second ink storage portion, placed approximately close to the ink outlet; and a spacing member, placed between the first and second ink storage portions and comprised of a plurality of ribs that oppositely abut the first and second ink storage portions to separate the first ink storage portion from the second ink storage portion.

2. The ink storage unit of claim 1, wherein the air inlet is substantially spaced away from the ink outlet.

3. The ink storage unit of claim 1, wherein the first ink storage portion has a capillary effect that is higher than that of the second ink storage portion.

4. The ink storage unit of claim 1, wherein a pore density of the first ink storage portion is higher than that of the second ink storage portion.

5. The ink storage unit of claim 1, wherein the first ink storage portion is made of a porous material.

6. The ink storage unit of claim 5, wherein the porous material includes a sponge.

7. The ink storage unit of claim 5, wherein the porous material includes a fabric.

8. The ink storage unit of claim 1, wherein the second ink storage portion is made of a porous material.

9. The ink storage unit of claim 8, wherein the porous material includes a sponge.

10. The ink storage unit of claim 8, wherein the porous material includes a fabric.

11. An ink storage unit, comprising:

an ink tank, defining an inner confinement space limited by at least an inner sidewall, and further provided with an air inlet and an ink outlet, the air inlet enabling an external air to enter the confinement space and the ink outlet enabling an ink to be outputted out of the confinement space; and an ink storage body, received within the confinement space, the ink storage body being comprised of:

a first ink storage portion, made of porous material and placed approximately close to the air inlet;

a second ink storage portion, made of porous material and placed approximately close to the ink outlet; and a spacing member, placed between the first and second ink storage portions to separate the first ink storage portion from the second ink storage portion such that the first ink storage portion does not physically contact the second ink storage portion.

12. The ink storage unit of claim 11, wherein the air inlet is substantially spaced away from the ink outlet.

13. The ink storage unit of claim 11, wherein the first ink storage portion has a capillary effect that is higher than that of the second ink storage portion.

14. The ink storage unit of claim 11, wherein a pore density of the first ink storage portion is higher than that of the second ink storage portion.

15. The ink storage unit of claim 11, wherein the first ink storage portion is made of sponge.

16. The ink storage unit of claim 11, wherein the first ink storage portion is made of fabric.

17. The ink storage unit of claim 11, wherein the second ink storage portion is made of sponge.

18. The ink storage unit of claim 11, wherein the second ink storage portion is made of fabric.

* * * * *